US012655627B2

(12) United States Patent
Castles et al.

(10) Patent No.: US 12,655,627 B2
(45) Date of Patent: Jun. 16, 2026

(54) MATERIAL AND METHOD FOR PROVIDING INSULATION TO A FOUNDATION WALL

(71) Applicant: Garland Industries, Inc., Cleveland, OH (US)

(72) Inventors: Lindsay Castles, Cleveland, OH (US); Steve Holcomb, Cleveland, OH (US)

(73) Assignee: Garland Industries, Inc., Independence, OH (US)

( * ) Notice: Subject to any disclaimer, the term of this patent is extended or adjusted under 35 U.S.C. 154(b) by 365 days.

(21) Appl. No.: 17/854,401

(22) Filed: Aug. 30, 2022

(65) Prior Publication Data

US 2023/0053240 A1 Feb. 16, 2023

Related U.S. Application Data

(60) Provisional application No. 63/216,852, filed on Jun. 30, 2021.

(51) Int. Cl.
*E04B 1/76* (2006.01)
*D04H 1/541* (2012.01)

(52) U.S. Cl.
CPC ..... *E04B 1/762* (2013.01); *D04H 1/5412* (2020.05); *E04B 1/7658* (2013.01)

(58) Field of Classification Search
CPC ..... E04B 1/762; E04B 1/7658; E04B 1/7662; E04B 1/7675; E04B 1/80; B32B 5/022; B32B 5/266; B32B 5/26; B32B 5/145; B32B 2307/304; Y02A 30/00
See application file for complete search history.

(56) References Cited

U.S. PATENT DOCUMENTS

| | | | | |
|---|---|---|---|---|
| 5,056,281 | A | 10/1991 | McCarthy | |
| 8,359,808 | B2 | 1/2013 | Stephens | |
| 2003/0008581 | A1* | 1/2003 | Tilton | B29C 43/203 156/196 |
| 2003/0199216 | A1* | 10/2003 | Gomez | D04H 1/74 442/327 |
| 2005/0148259 | A1* | 7/2005 | Tilton | G10K 11/165 442/361 |
| 2007/0066176 | A1* | 3/2007 | Wenstrup | D04H 1/54 428/218 |
| 2009/0085378 | A1* | 4/2009 | Borchardt | B32B 5/06 296/191 |
| 2009/0183446 | A1* | 7/2009 | Nielsen | B32B 5/10 428/141 |

(Continued)

FOREIGN PATENT DOCUMENTS

| | | |
|---|---|---|
| CA | 2988514 | 2/2019 |
| CN | 209114638 | 7/2019 |

(Continued)

OTHER PUBLICATIONS

Machine Translation of EP0550873 (Year: 1993).*

*Primary Examiner* — Jennifer A Steele
(74) *Attorney, Agent, or Firm* — UB Greensfelder LLP; Brian E. Turung

(57) ABSTRACT

A material and method for insulating a top portion of a foundation wall which includes a non-woven thermoplastic board for insulating a foundation wall. The non-woven thermoplastic board has a thermal resistance of an R-value per inch thickness of at least 1.

20 Claims, 5 Drawing Sheets

(56) References Cited

U.S. PATENT DOCUMENTS

| | | | | |
|---|---|---|---|---|
| 2013/0327705 | A1* | 12/2013 | Clark | G10K 11/168 181/294 |
| 2017/0022682 | A1 | 1/2017 | Hicks | |

FOREIGN PATENT DOCUMENTS

| | | | | |
|---|---|---|---|---|
| CN | 112112297 | | 12/2020 | |
| DE | 2043030 | | 4/1971 | |
| EP | 0550873 | A1 * | 7/1993 | E04F 13/08 |

* cited by examiner

MATERIAL AND METHOD FOR PROVIDING INSULATION TO A FOUNDATION WALL

The present disclosure claims priority on U.S. Provisional Patent Application Ser. No. 63/216,852 filed Jun. 30, 2021, which is incorporated herein by reference.

The present disclosure relates to a material and method for providing insulation to a foundation wall.

BACKGROUND OF THE DISCLOSURE

Insulating the foundation of building structures, such as residential homes and commercial buildings, is important for many reasons. Insulation for a building's foundation wall can control the heat exchange between the ground and the interior of the foundation wall, thus saving energy. Insulation can also provide a hydrostatic pressure barrier between the surrounding earth and the foundation wall, thus providing structural advantages.

As energy efficiency has become a focus for the residential and commercial construction market, codes have changed to require more R-Value in traditional areas as well as new ones. Code bodies are looking for an overall increase in energy efficiency to lower the energy consumption of the modern-day home and structure.

The prescriptive code requires an R-10 full wall in a number of states. Currently, there are few builders that insulate the full wall on the outside of the home or structure. This is primarily because of the lack of satisfactory solutions for insulating the full outside wall. In addition, the available options are expensive relative to the overall appearance of the end result. The expense is derived not only by the cost of the materials, but by the amount of detailed labor required to make many of the solutions aesthetically pleasing. The cost/value ratio is not enticing for the systems that are currently available. Also, some of these systems don't hold up over time due to material limitations and constraints.

One known product used for insulating is fiberglass boards applied against the foundation wall after a waterproof coating has been applied to the foundation wall. The fiberglass boards can provide a thermal resistance for insulating the foundation wall, and can provide a compression resistance to relieve the structure from some of the hydrostatic pressure that results from the surrounding earth.

However, fiberglass boards can be dangerous to manually install as the glass from the fiberglass can be very irritating and damaging to the installer's skin. Also, the installation of fiberglass boards is a labor-intensive system that can be very expensive to install. Furthermore, the fiberglass boards are sensitive to sunlight, thus will degrade with prolonged exposure to UV light from the sun. As such, the fiberglass boards require the foundation wall to be immediately back-filled when fiberglass boards are installed about the exterior foundation wall. Also, the fiberglass boards do not stand up well to the changing hydrostatic pressures when back-filled, i.e., the fiberglass board tends to break down or be crushed under the constantly changing pressure between the exterior foundation wall and the earth surrounding the foundation wall. Also, during installation of the fiberglass boards, the fiberglass boards need to be bonded to the exterior of the foundation wall. Adhesives such as phenolic and formaldehyde resins are commonly used. However, such adhesives are known to be dangerous to the environment. Furthermore, the fiberglass boards are not aesthetically pleasing; thus, builders and homeowners are generally not pleased with the final look of the exterior foundation wall after the fiberglass boards are installed.

Another product that may be used for insulating an exterior foundation wall are dimpled plastic sheets. Like the fiberglass boards, the dimpled plastic sheets are applied against the foundation wall. The dimpled plastic sheets can either be applied directly to the foundation wall or be applied after the application of a waterproof membrane. When applied after the waterproof membrane, the dimples on the dimpled plastic sheets face towards the soil with a filter fabric typically either glued or thermally bonded to the dimple side. However, the dimpled plastic sheet provides no thermal resistance. In addition, the dimpled plastic sheets can easily be crushed or damaged on the job site and are more difficult to install than fiberglass boards. Furthermore, the waterproof membrane must be allowed to cure and dry for 24-36 hours before the dimpled plastic sheet can be applied and secured to the waterproof membrane, thus adding extra time and delay to the building process.

Another product used for insulating the exterior of a foundation wall is expanded and extruded styrene foam. However, such materials are expensive to obtain and labor intensive to install and also do not have long-term durability.

Currently, it is cheaper to achieve code compliance by insulating the inside of the basement wall. However, there are major drawbacks to such a strategy, namely 1) the insulation on the interior surface of the basement wall is exposed and visible to the homeowner, thus is not aesthetically pleasing to the homeowner; 2) moisture can condensate behind the insulation in the basement, thus potentially causing mold problems in the basement which can result in unwanted odors and be unhealthy to individuals and pets; and 3) when fiberglass insulation is used, exposure to the fiberglass insulation to pets and individuals in the basement can be unhealthy. As such, the visible insulation creates poor aesthetics and can result in condensation formation behind the insulation that can lead to mold and mildew growth. It is not uncommon to peel back the insulation on the inside basement wall and find black patches in as little as 3-6 months after a new home has been built and occupied.

The present disclosure discloses an insulation material for a foundation wall that addresses many, if not all, of the problems mentioned above.

SUMMARY OF THE DISCLOSURE

The present disclosure pertains to an improved foundation wall insulation board and method for using the improved foundation wall insulation board to insulate a foundation wall, and typically to an improved foundation wall insulation board and method for using the improved foundation wall insulation board to insulate an exterior of a foundation wall. The improved foundation wall insulation board includes a non-woven thermoplastic board. The improved foundation wall insulation board has a thermal resistance of an R-value per inch thickness of at least 1, generally at least 5, and typically 5-25 (and all values and ranges therebetween). The improved foundation wall insulation board is a generally rigid board that cannot be rolled. The generally rigid improved foundation wall insulation board can be slightly bent without causing the generally rigid improved foundation wall insulation board to break. In one non-limiting embodiment, the generally rigid improved foundation wall insulation board having a length of 4 feet along its longitudinal axis, a width of 2 feet, and a thickness of about 2 inches can be bent from 0-40° (and all values and ranges therebetween) along the longitudinal axis of the improved foundation wall insulation board without causing the improved foundation wall insulation board to break, crack, or otherwise be damaged. In another non-limiting embodiment, the generally rigid improved foundation wall insulation board having a length of 4 feet long along its longitudinal axis, a width of 2 feet, and a thickness of about 2 inches can be bent from 0-25° along the longitudinal axis of the improved foundation wall insulation board without causing the improved foundation wall insulation board to break, crack, or otherwise be damaged.

In accordance with a non-limiting aspect of the disclosure, the improved foundation wall insulation board includes a non-woven thermoplastic board that includes an outer skin layer on the front and/or back sides of the non-woven thermoplastic board, which outer skin layer 1) provides strength to the improved foundation wall insulation board, 2) provides rigidity to the improved foundation wall insulation board, 3) increases the density of the improved foundation wall insulation board compared to the density of the non-woven thermoplastic board located adjacent the outer skin layer, and/or 4) reduces the porosity and/or rate of water drainage through the outer skin layer of the improved foundation wall insulation board compared to other regions of the improved foundation wall insulation board (such as through the non-woven thermoplastic board that is absent the outer skin layer). In one non-limiting embodiment, the improved foundation wall insulation board includes a non-woven thermoplastic board that has an outer skin layer on both the front and back sides of the non-woven thermoplastic board. The outer skin layer is formed from a compressed outer region of the non-woven thermoplastic board, which compressed outer region has a higher density (e.g., a density of 10-500% greater, and all values and ranges therebetween) than the density of the non-woven thermoplastic board that is located in the center of the non-woven thermoplastic board. In another non-limiting embodiment, the average thickness of the outer skin layer is 0.01-0.5 in. (and all values and ranges therebetween), and generally 0.03-0.25 in. In another non-limiting embodiment, the outer skin layer is absent from a portion (e.g., 5-99% and all values and ranges therebetween) or all of the perimeter edges and/or perimeter sides of the non-woven thermoplastic board.

In accordance with a non-limiting aspect of the disclosure, the improved foundation wall insulation board optionally includes an outer coating on a) the front and/or back sides of the non-woven thermoplastic board, and/or 2) a portion (e.g., 5-99% and all values and ranges therebetween) or all of the perimeter edges and/or perimeter sides of the non-woven thermoplastic board. In one non-limiting embodiment, the outer coating can optionally be formulated to a) improve the strength of the improved foundation wall insulation board, b) increase the rigidity of the improved foundation wall insulation board, c) improve the durability of the improved foundation wall insulation board, d) provide a waterproof layer on the improved foundation wall insulation board, and/or e) provide a UV protected layer that provides UV protection to one or more components of the improved foundation wall insulation board (e.g., the non-woven material of the non-woven thermoplastic board, etc.). In one non-limiting embodiment, the improved foundation wall insulation board includes an outer coating only on the front or back side of the non-woven thermoplastic board. In another non-limiting embodiment, the improved foundation wall insulation board includes an outer coating on both the front and back side of the non-woven thermoplastic board. In another non-limiting embodiment, the improved foundation wall insulation board includes an outer coating on the perimeter edges of the non-woven thermoplastic board. In another non-limiting embodiment, the improved foundation wall insulation board includes an outer coating on only a portion of the perimeter edges of the non-woven thermoplastic board. In another non-limiting embodiment, the thickness of the outer coating is 5-150 mils (and all values and ranges therebetween), and generally 40-80 mils. In another non-limiting embodiment, the composition of the outer coating is non-limiting. In one non-limiting formulation, the outer coating can include a polymer, bitumen, modified bitumen, polymer coting, UV protectant coating, sealant, antimicrobial coating. The outer coating can be spray coated, brush coated, dip coated, etc. The outer coating (when used) can be pre-coated on the non-woven thermoplastic board prior to the improved foundation wall insulation board being positioned on the foundation wall; however, it can be appreciated that the outer coating can be applied to the non-woven thermoplastic board prior, during, and/or after the improved foundation wall insulation board is positioned on the foundation wall.

In accordance with a non-limiting aspect of the disclosure, the outer surface of the improved foundation wall insulation board can optionally include one or more layers of exterior material such as plastic sheeting, woven fabric, fiber board, panel, etc. The exterior material can be secured by use of adhesive connection, melt bond, mechanically connection, etc.

In accordance with a non-limiting aspect of the disclosure, the improved foundation wall insulation board optionally has one or more chamfered edges.

In accordance with a non-limiting aspect of the disclosure, the improved foundation wall insulation board has a size of 5-35 in. wide (and all values and ranges therebetween), 10-80 in. long (and all values and ranges therebetween) along a longitudinal length of the improved foundation wall insulation board, and a thickness of 0.5-5 in. (and all values and ranges therebetween), and generally 10-20 in. wide, 30-40 in. long, and 2-3 in. thick. In another non-limiting embodiment, the non-woven thermoplastic board may be provided with a thickness of 1-4 in., and generally 2-3 in. In another non-limiting embodiment, the non-woven thermoplastic board may be provided with a length and a width or 10-25 in. width and 25-60 in. length. The improved foundation wall insulation board can optionally have a rectangular or square profile. As can be appreciated, the improved foundation wall insulation board can have other sizes and/or shapes.

In accordance with a non-limiting aspect of the disclosure, the improved foundation wall insulation board can optionally be configured to be non-rollable.

In accordance with a non-limiting aspect of the disclosure, the improved foundation wall insulation board can optionally be configured to have a vertical drainage ability per inch thickness of less than 125 gallons/hour/lineal-foot/inch at a pressure of 500 pounds per square foot (psf), and generally has a vertical drainage ability per inch thickness of no more than 100 gallons/hour/lineal-foot/inch at a pressure of 500 pounds per square foot (psf). As can be appreciated, the improved foundation wall insulation board can be configured to have other vertical drainage ability per inch thickness.

In accordance with a non-limiting aspect of the disclosure, the non-woven thermoplastic board used to partially or fully form the improved foundation wall insulation board is optionally at least partially formed of polymer fiber material (e.g., polyester fibers, polyamide fibers, polyamide nylon fibers, nylon, fibers, PET fibers, PBT fibers, phenol-formaldehyde (PF) fibers, polyvinyl chloride fiber (PVC) fibers, polyolefin fibers, acrylic polyester fibers. polyethylene (PE)

fibers, urethane fibers, polyurethane fibers, elastolefin, etc.). Some or all of the polymer fiber material is formed of non-woven polymer fibers.

In accordance with a non-limiting aspect of the disclosure, the non-woven thermoplastic board used to partially or fully form the improved foundation wall insulation board is optionally at least partially formed of a blend of a polymer material (e.g., polymer shoddy [e.g., polyester shoddy, nylon shoddy, etc.], etc.) and non-woven polymer fiber material. In another non-limiting embodiment, when the non-woven thermoplastic board formed of a blend of a polymer material and non-woven polymer fiber material, the non-woven polymer fiber material constitutes 25-80 wt. % of the non-woven thermoplastic board (and all values and ranges therebetween), and typically 30-60 wt. % of the non-woven thermoplastic board. The polymer material can be or include shredded polymer fibers and/or shredded polymer fabric.

In accordance with a non-limiting aspect of the disclosure, the non-woven thermoplastic board used to partially or fully form the improved foundation wall insulation board is optionally at least partially formed of polymer fiber material where a portion (e.g., 5-99% and all values and ranges therebetween) or all of the polymer fiber material is a bi-component fiber (i.e., a polymer fiber that is coated with a different material). In another non-limiting embodiment, the bi-component fiber has an outer coating that has a melting point that is less than the core fiber of the bi-component fiber. The outer coating of the bi-component fiber can be a polymer compound; however, this is not required.

In accordance with a non-limiting aspect of the disclosure, the non-woven thermoplastic board used to partially or fully form the improved foundation wall insulation board is optionally at least partially formed of a blend of a polymer material and non-woven polymer fiber material, wherein a portion or all of the polymer fiber material is a bi-component fiber and wherein the outer coating of the bi-component fiber has a melting point that is less than the polymer material and the core fiber of the bi-component fiber.

In accordance with a non-limiting aspect of the disclosure, the non-woven thermoplastic board used to partially or fully form the improved foundation wall insulation board is optionally formed by an airlay line process to create a board thickness of about 2-8 in. (and all values and ranges therebetween), then heat pressed to a thickness of 0.5-5 in., and then optionally punched or otherwise cut into blanks. In one non-limiting embodiment, the non-woven thermoplastic board is compressed or heat pressed to reduce the thickness of the non-woven thermoplastic board by 10-300% (and all values and ranges therebetween), and to at least partially form the outer skin layer on the front and/or back sides of the non-woven thermoplastic board. In one specific non-limiting manufacturing process for the non-woven thermoplastic board, the non-woven thermoplastic board is made using a blend of recycled polyester shoddy with a 4 denier 1.25 in. staple bi-component fiber. The bi-component content will be about 30-60 wt. % of the non-woven thermoplastic board to impart stiffness to the non-woven thermoplastic board. The fiber constituents and the recycled polyester shoddy are blended in an air lay line and made into a high loft web (e.g., using a LaRoche process, etc.). Once the non-woven thermoplastic board is made to an appropriate thickness (e.g., 3.5-5 in. thick), the non-woven thermoplastic board is subjected to compressing process. The compressing process can optionally include a double belt press consolidation oven used to reduce the thickness of the non-woven thermoplastic board to about 2.75 in. thick. The compressing process imparts an outer skin layer to both sides of the non-woven thermoplastic board. Use of such compressing process can result in a more consistently thick non-woven thermoplastic board compared to other types of compression processes. The thickness of the outer skin layer on both sides of the non-woven thermoplastic board is generally the same (however, this is not required), and is typically about 0.05-0.2 in. The final size of the non-woven thermoplastic board can be formed by punch cutting the non-woven thermoplastic board into blanks of approximately 15×36 in. rectangle using a dye and press. The punched out blanks of the non-woven thermoplastic board can optionally be further processed by a) subjecting the blanks to a cut/trim process to add a chamfered edge on one or more edges of the blanks of the non-woven thermoplastic board, and/or b) partially or fully coating the blanks with an outer coating (e.g., a UV-stable coating, waterproof coating, UV-stable elastomeric waterproof coating, antimicrobial coating, etc.). When the blanks optionally include one or more chamfered edges, the chamfered edges can be used to 1) improve the aesthetics of the formed blank, and/or 2) hide or mask imperfections to the blank regarding thickness variations in the blank (especially after the improved foundation wall insulation board has been installed on a foundation wall). As such, the chamfered edges can make the final improved foundation wall insulation board more visually appealing than a flat rectangular or square panel.

In accordance with a non-limiting aspect of the disclosure, the weight of the non-woven thermoplastic board used to partially or fully form the improved foundation wall insulation board that is about 2.75 in. thick optionally has a GSM of about 3100-6000 (and all values and ranges therebetween), and generally 3400-4500 GSM.

In accordance with a non-limiting aspect of the disclosure, the non-woven thermoplastic board used to partially or fully form the improved foundation wall insulation board can be positioned directly adjacent a foundation wall, or be positioned adjacent to a foundation wall after a waterproofing membrane is applied to the foundation wall, etc. As can be appreciated, one or more materials can be inserted between the foundation wall and the improved foundation wall insulation board (e.g., waterproof coating or sheet, UV coating or sheet, other insulation layers, adhesive layer, etc.).

In accordance with a non-limiting aspect of the disclosure, the improved foundation wall insulation board may optionally be used for providing adequate insulation for a foundation wall to control the heat exchange between the exterior exposed surface and the interior of the foundation wall, thus saving energy. The thermal resistance of the improved foundation wall insulation board may be any thermal resistance including, but not limited to, having an R-value of greater than 1 as measured by ASTM Test Number C-518. For example, the thermal resistance of the improved foundation wall insulation board may be an R-value of 6-15 (and all values and ranges therebetween) for a 2¾ in. thick sheet.

In accordance with a non-limiting aspect of the disclosure, the improved foundation wall insulation board may optionally include one or more stiffeners and/or fillers. The stiffener (when used) may be any material applied to the non-woven thermoplastic board for stiffening or hardening the non-woven thermoplastic board used to partially or fully form the improved foundation wall insulation board. In one non-limiting embodiment, the stiffener (when used) may be a resin, a film (extruded, melt-blown, etc.), a woven facer fabric, a non-woven facer fabric, etc. The stiffener may be applied anytime, including, but not limited to, during manufacturing of the non-woven thermoplastic board or any time thereafter. The stiffer can also be used to a) increase the strength of the non-woven thermoplastic board, and/or b) increase the durability of the non-woven thermoplastic board. The filler (when used) can be any type of filler (e.g., carbon fibers, boron fibers, fiberglass fibers, glass balls, ceramic balls, carbon balls, metal fibers, etc.). The filler can optionally be used to a) increase the strength of the non-woven thermoplastic board, b) increase the durability of the non-woven thermoplastic board, c) increase the stiffness of the non-woven thermoplastic board, and/or c) change the density of the non-woven thermoplastic board. The one or more stiffeners and/or fillers, when used, constitute 2-70 wt. % (and all values and ranges therebetween) of the non-woven thermoplastic board.

In accordance with a non-limiting aspect of the disclosure, the improved foundation wall insulation board may optionally be manufactured such that the improved foundation wall insulation board has one or more accordion-shaped portions along the cross-section of the improved foundation wall insulation board. The method of manufacturing the non-woven thermoplastic board to have one or more accordion-shaped portions can be by a vertical lapping process, which may include the steps of 1) supplying staple fiber to a card(s), 2) carding the web of fiber, and 3) moving the web of fiber into a vertical lapping machine (such as the commercial machine known as Strudo). The fiber can be compressed and then punched or otherwise cut into boards of non-woven thermoplastic board.

In accordance with a non-limiting aspect of the disclosure, the non-woven thermoplastic board used to partially or fully form the improved foundation wall insulation board can be formed by a carding and cross-lapping process, where the non-woven fibers may be carded and cross lapped. In this carded and cross-lapping process, the non-woven thermoplastic board may be made by carding and cross lapping (90°) a plurality of fibers including a binder (including, but not limited to, low melt fibers, a thermal plastic powder, bi-component fibers, chemicals, and the like), plying the non-woven fibers to a certain thickness, and subsequently bonding the non-woven fibers and binders together. During the bonding process, the non-woven thermoplastic board can be densified to a predetermined density using compression via equipment that includes, but is not limited to, a press, calender, or double belt process.

In accordance with a non-limiting aspect of the disclosure, the non-woven thermoplastic board used to partially or fully form the improved foundation wall insulation board can be formed by a wet lay process. This wet lay process may include the steps of providing and sending a wet lay web of non-woven fibers into an oven for bonding to form the non-woven thermoplastic board. Prior to being heated in the oven, the web of non-woven fibers can optionally be pleated form an accordion-shaped non-woven thermoplastic board.

In accordance with a non-limiting aspect of the disclosure, the non-woven thermoplastic board used to partially or fully form the improved foundation wall insulation board can be formed by a Spunbond process. The Spunbond process may include the steps of providing and sending a Spunbond web of non-woven fibers into an oven for bonding into the non-woven thermoplastic board. Prior to being heated in the oven, the web of non-woven fibers can optionally be pleated to form an accordion-shaped non-woven thermoplastic board has an.

In accordance with a non-limiting aspect of the disclosure, the non-woven thermoplastic board used to partially or fully form the improved foundation wall insulation board can be formed by a block process. In this block process, the non-woven thermoplastic board may be a fibrous mat structure that may be manufactured by opening and depositing a plurality of fibers, (including binders) into a large rectangular container (box) which can be heated and have pressure applied from the top of the box. The fibers are heated and pressed to the desired density and then cooled. The resulting block can then be skived like a block of foam into sheets of desired thickness.

In accordance with a non-limiting aspect of the disclosure, the non-woven thermoplastic board used to partially or fully form the improved foundation wall insulation board can be formed by an airlay process. This airlay process may include the steps of taking non-woven fibers through a mechanical opening process and then using a large volume of air to transport the non-woven fibers to a forming head which deposits a uniform layer of non-woven fibers onto a moving conveyer belt. These open fibers can then be pressed down to a certain thickness for the desired thermal resistance using a machine like a double belt press.

In accordance with a non-limiting aspect of the disclosure, the non-woven thermoplastic board used to partially or fully form the improved foundation wall insulation board can be formed by a laminate/composite process. In this laminate/composite process, webs made by any non-woven, woven, or knitted process may be laminated together to form the non-woven thermoplastic board. In this laminate/composite process, the non-woven thermoplastic board can be formed of different materials (which materials could include an entangled net product, a dimpled plastic sheet, and/or bentonite panels) that are laminated to the non-woven thermoplastic board on one or both sides of the non-woven thermoplastic board. In this construction, the entangled net product and dimpled plastic sheet may be positioned next to the foundation wall. As can be appreciated, the dimpled plastic sheet and/or bentonite panels can be used on any of the other processes discussed above. Also, with any embodiments of manufacturing of the non-woven thermoplastic board as discussed above, the top and/or bottom surfaces can be subjected to heat and/or pressure to form an outer skin layer to one or both sides of the non-woven thermoplastic board.

In accordance with a non-limiting aspect of the disclosure, the non-woven thermoplastic board used to partially or fully form the improved foundation wall insulation board can be made without the use of phenolic and formaldehyde resins, which makes the non-woven thermoplastic board more environmentally friendly. The non-woven thermoplastic board may also be made out of recycled post-consumer and industrial waste, thus providing even more environmental benefits. Furthermore, unlike fiberglass boards, the non-woven thermoplastic board will not irritate or harm a person's skin. Furthermore, the non-woven thermoplastic board resists degradation when exposed to UV rays or sunlight, thus, the non-woven thermoplastic board can be installed on the exterior of a foundation without needing to be immediately back filled or covered, and can be stored on a job site without UV protection.

In accordance with a non-limiting aspect of the disclosure, the outer portion of a foundation can be at least partially insulated by use of the improved foundation wall insulation board in accordance with the present disclosure. Generally, the improved foundation wall insulation board in accordance with the present disclosure is used to insulate the exterior portion of a foundation that extends above the ground surface; however, it can be appreciated that the improved foundation wall insulation board in accordance with the present disclosure can be used to insulate the exterior portion of a foundation that extends 0-5+ feet (and all values and ranges therebetween) below the ground surface.

In accordance with a non-limiting aspect of the disclosure, one non-limiting method for insulating an exterior portion of a foundation that extends above the ground surface includes: 1) optionally applying a waterproofing and/or a UV-protection coating, and/or a waterproofing and/or protection sheet layer to the exterior surface of the foundation; 2) placing one or more boards of the improved foundation wall insulation board over the exterior surface of the foundation or the exterior surface of the waterproofing coating or sheet layer previously applied to the exterior surface of the foundation; 3) mechanically and/or adhesively and/or heat bonding the one or more boards of the improved foundation wall insulation board to the exterior surface of the foundation and/or to the exterior surface of the waterproofing coating or sheet previously applied to the exterior surface of the foundation; and 4) optionally applying and/or securing a waterproofing and/or UV-protection coating, and/or waterproofing and/or UV sheet to the exterior surface of the one or more boards of the improved foundation wall insulation board. When the one or more boards of the improved foundation wall insulation board include a pre-coated waterproofing and/or UV-protection coating and/or layer on the front and/or back surface, at least one of the sides of the one or more boards of the improved foundation wall insulation board that includes the pre-coated waterproofing and/or UV-protection coating and/or layer generally faces away from the exterior surface of the foundation. Such an arrangement reduces or prevents water from entering the interior body portion of the one or more boards of the improved foundation wall insulation board and/or increases the life of the improved foundation wall insulation board. When the one or more boards of the improved foundation wall insulation board include a pre-coated waterproofing and/or UV-protection coating and/or layer on at least the top edge of the improved foundation wall insulation board, the board of the improved foundation wall insulation board is generally installed such that the top edge faces upwardly on the foundation wall. Such an arrangement reduces or prevents water from entering the interior body portion of the improved foundation wall insulation board.

In one non-limiting object of the present disclosure there is provided a foundation wall insulation board that can be used to provide insulation to an exterior of a foundation wall; wherein the foundation wall insulation board comprises a non-woven board and an outer skin layer; and wherein the non-woven board includes a top surface, a bottom surface and a side edge; and wherein the outer skin layer is located on the top surface and/or the bottom surface of the non-woven board; and wherein the outer skin layer is formed of the same or substantially the same material as the non-woven board; and wherein the outer skin layer has a density that is greater than a density of the center or central portion of the non-woven board; and wherein the outer skin layer has a thickness that is less than a thickness of the non-woven board; and wherein the non-woven board is at least partially formed of a plurality of fibers, and wherein some or all of the fibers are not woven together; and wherein the foundation wall insulation board has a thermal resistance having an R-value per inch thickness of at least 1.

In another non-limiting object of the present disclosure there is provided a foundation wall insulation board wherein the thermal resistance having an R-value per inch thickness of at least 2.

In another non-limiting object of the present disclosure there is provided a foundation wall insulation board wherein the fibers optionally include polymer fibers.

In another non-limiting object of the present disclosure there is provided a foundation wall insulation board wherein the polymer fibers, when used, optionally include polyester fibers.

In another non-limiting object of the present disclosure there is provided a foundation wall insulation board wherein a plurality of said fibers are optionally coated with a polymer coating; and wherein the polymer coating, when used, has a metaling point that is less than a melting point of the fiber.

In another non-limiting object of the present disclosure there is provided a foundation wall insulation board wherein the foundation wall insulation board optionally includes shoddy, stiffeners and/or fillers.

In another non-limiting object of the present disclosure there is provided a foundation wall insulation board wherein the foundation wall insulation board optionally includes one or more supplemental layers that are secured to at least a portion of a top surface of the outer skin layer; and wherein the one or more supplemental layers optionally include woven fiber material, plastic sheet, and/or panels.

In another non-limiting object of the present disclosure there is provided a foundation wall insulation board wherein the foundation wall insulation board optionally includes an outer coating on at least a portion of the foundation wall insulation board; and wherein the outer coating optionally includes one or more materials selected from the group consisting of waterproof material, sealant, UV protectant, and antimicrobial coating.

In another non-limiting object of the present disclosure there is provided a foundation wall insulation board wherein at least a portion of the side edge is optionally chamfered.

In another non-limiting object of the present disclosure there is provided a method for manufacturing a foundation wall insulation board that comprises a) providing a plurality of fibers; and wherein some or all of the fibers are not woven together; b) laying the plurality of fibers so as to form a form of fibers; and wherein the form of fibers has an initial thickness; and wherein the form of fibers has a top surface and a bottom surface; c) compressing the form of fibers to reduce a thickness of the form of fibers from the initial thickness to a compressed thickness to produce a non-woven board; and wherein the compressed thickness is less than the initial thickness; and d) forming an outer skin layer on the top surface and/or the bottom surface of the non-woven board to form the foundation wall insulation board; and wherein the outer skin layer is formed of the same or substantially the same material as the non-woven board; and wherein the outer skin layer has a density that is greater than a density of the center or central portion of the non-woven board; and wherein the outer skin layer has a thickness that is less than a thickness of the non-woven board; and wherein the foundation wall insulation board has a thermal resistance having an R-value per inch thickness of at least 1.

In another non-limiting object of the present disclosure there is provided a method for manufacturing a foundation wall insulation board wherein the step of compressing optionally causes at least a portion of a polymer coating on a plurality of the fibers having the polymer coating to soften or at least partially melt.

In another non-limiting object of the present disclosure there is provided a method for manufacturing a foundation wall insulation board wherein the step of compressing optionally includes applying heat to the form of fibers.

In another non-limiting object of the present disclosure there is provided a method for manufacturing a foundation wall insulation board that further optionally includes the step of applying one or more supplemental layers to at least a portion of a top surface of the outer skin layer; and wherein the one or more supplemental layers optionally include woven fiber material, plastic sheet, and/or panels.

In another non-limiting object of the present disclosure there is provided a method for manufacturing a foundation wall insulation board that further optionally includes the step of applying one or more outer coatings to an outer surface of the foundation wall insulation board and/or to the outer surface of the outer skin layer; and wherein the outer coating optionally includes one or more materials selected form the group consisting of adhesive, waterproof material, sealant, UV protectant, and antimicrobial coating.

In another non-limiting object of the present disclosure there is provided a method for manufacturing a foundation wall insulation board that further optionally includes the step of chamfering at least a portion of a side edge of the foundation wall insulation board.

In another non-limiting object of the present disclosure there is provided an insulated foundation for a building comprising a) a foundation wall; and b) a foundation wall insulation board positioned adjacent to the foundation wall.

In another non-limiting object of the present disclosure there is provided an insulated foundation for a building wherein the foundation wall insulation board is optionally located adjacent to an exterior surface of the foundation wall.

In another non-limiting object of the present disclosure there is provided an insulated foundation for a building wherein the foundation wall insulation board is optionally connected to the foundation wall by a connection arrangement; and wherein the connection arrangement optionally includes one or more of adhesive, staple, nail, screw, clip, clamp, rivet, hook, strap, cord, wire, and/or tape.

In another non-limiting object of the present disclosure there is provided an insulated foundation for a building wherein at least a portion of the foundation wall insulation board is optionally located above a ground surface.

In another non-limiting object of the present disclosure there is provided an insulated foundation for a building wherein one or more intermediate layers are optionally positioned between the foundation wall and the foundation wall insulation board; and wherein the one or more intermediate layers optionally include a waterproof coating, waterproofing membrane, adhesive strips or tape, a sealant coating, an adhesive coating, a UV coating, a drainage board, a dimpled plastic sheet, a panel, drainage pipe, paint, antimicrobial coating, and/or an insulation material.

In another non-limiting object of the present disclosure there is provided a method for forming an insulated foundation comprising a) providing a foundation wall; b) providing a foundation wall insulation board; and c) positioning the foundation wall insulation board adjacent to the foundation wall.

These and other objects and advantages will become apparent from the discussion of the distinction between the disclosure and the prior art and when considering the non-limiting embodiment illustrated in the accompanying drawings.

BRIEF DESCRIPTION OF THE DRAWINGS

Reference may now be made to the drawings, which illustrate various non-limiting aspects of embodiments that the disclosure may take in physical form and in certain parts and arrangements of parts wherein.

DETAILED DESCRIPTION OF NON-LIMITING EMBODIMENTS

Figure 1:
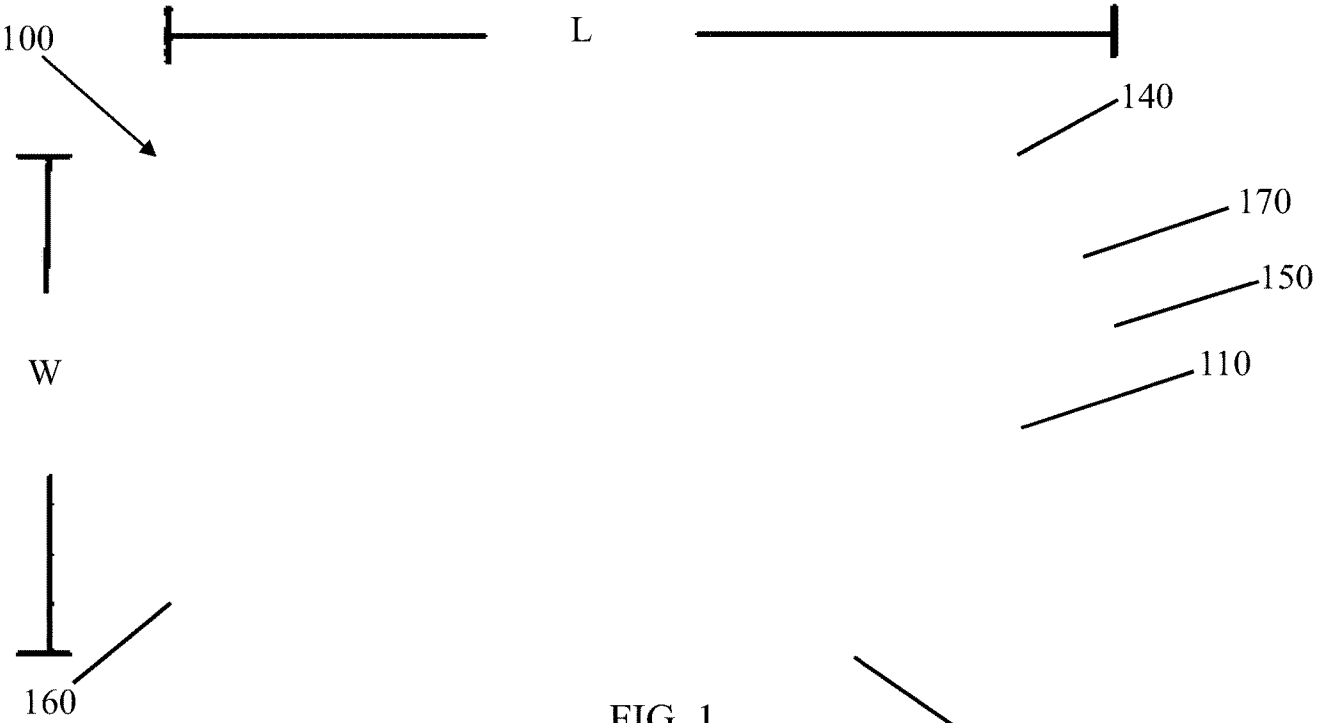
FIG. 1 is a top plan view of a non-limiting foundation wall insulation board in accordance with the present disclosure.
Figure 2:
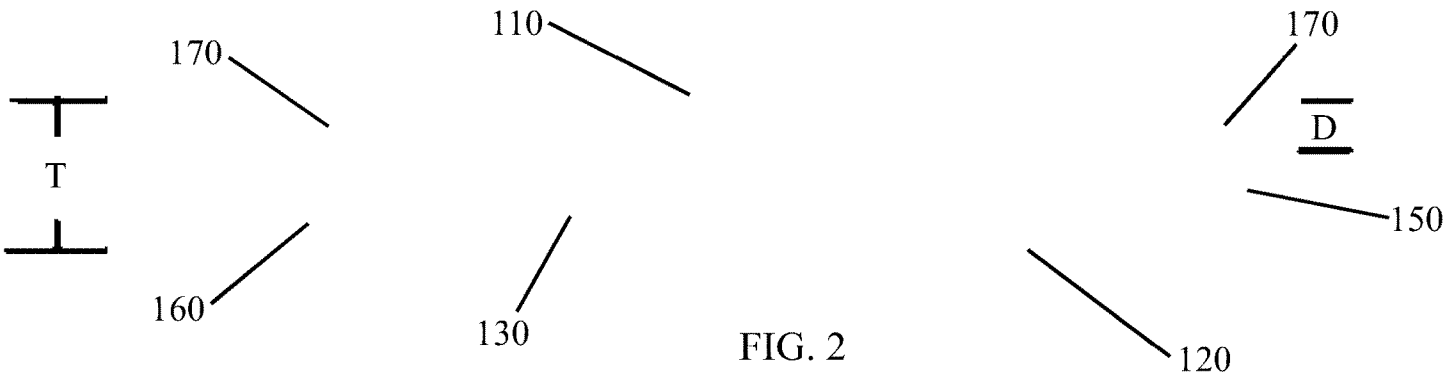
FIG. 2 is a side end view of the foundation wall insulation board of FIG. 1.

A more complete understanding of the articles/devices, processes and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" can be used to include any numerical value that can vary without changing the basic function of that value. When used with a range, "about" and "approximately" also disclose the range defined by the absolute values of the two endpoints, e.g., "about 2 to about 4" also discloses the range "from 2 to 4." Generally, the terms "about" and "approximately" may refer to plus or minus 10% of the indicated number.

Percentages of elements should be assumed to be percent by weight of the stated element, unless expressly stated otherwise.

Referring now to the drawings, wherein the showings are for the purpose of illustrating non-limiting embodiments of the disclosure only and not for the purpose of limiting the same, FIGS. 1-4 illustrate a non-limiting embodiment of a foundation wall insulation board 100 in accordance with the present disclosure.

The foundation wall insulation board 100 is particularly designed for insulating a foundation of a house, building, or other type of structure. The foundation wall insulation board 100 may be used for insulating any portion of a building's structure, including, but not limited to, walls, roofs, foundations, and/or retaining walls.

Figure 4:
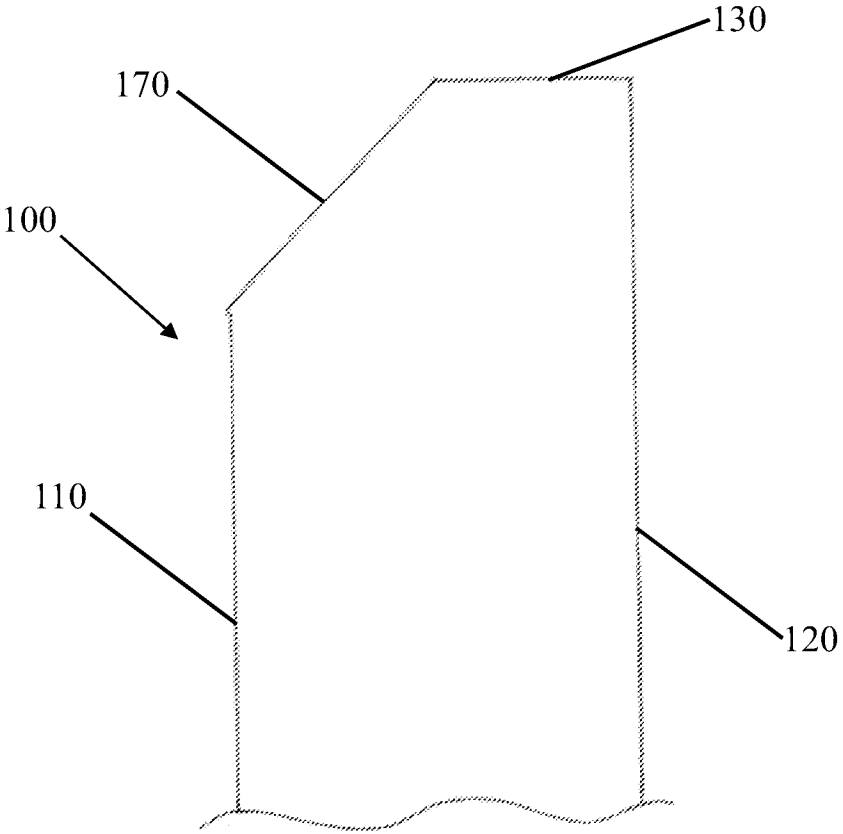
FIG. 4 is an enlarged view of an edge portion of the foundation wall insulation board of FIG. 1.

The foundation wall insulation board 100 is illustrated in FIG. 1 as a rectangular-shaped board; however, it will be appreciated that the foundation wall insulation board 100 can have other shapes. As illustrated in FIG. 1, the foundation wall insulation board 100 includes a top side 110, a bottom side 120, a front edge 130, a rear edge 140, a first side edge 150 and a second side edge 160. One or more of the edges can optionally include a chamfered portion 170 as illustrated in FIGS. 1 and 4. The length L of the foundation wall insulation board 100 is generally 4-6 feet; however, other lengths can be used. The width W of foundation wall insulation board 100 is generally 1.5-3 feet; however, other widths can be used. The thickness T of foundation wall insulation board 100 is generally 2-4 in.; however, other thicknesses can be used. The depth D of the optional chamfered edge 170 is generally 10-100% the thickness T of foundation wall insulation board 100, and typically 30-65% the thickness T of foundation wall insulation board 100. The width of the optional chamfered edge 170 is generally less than 5% of the length L of the foundation wall insulation board 100.

Figure 3:
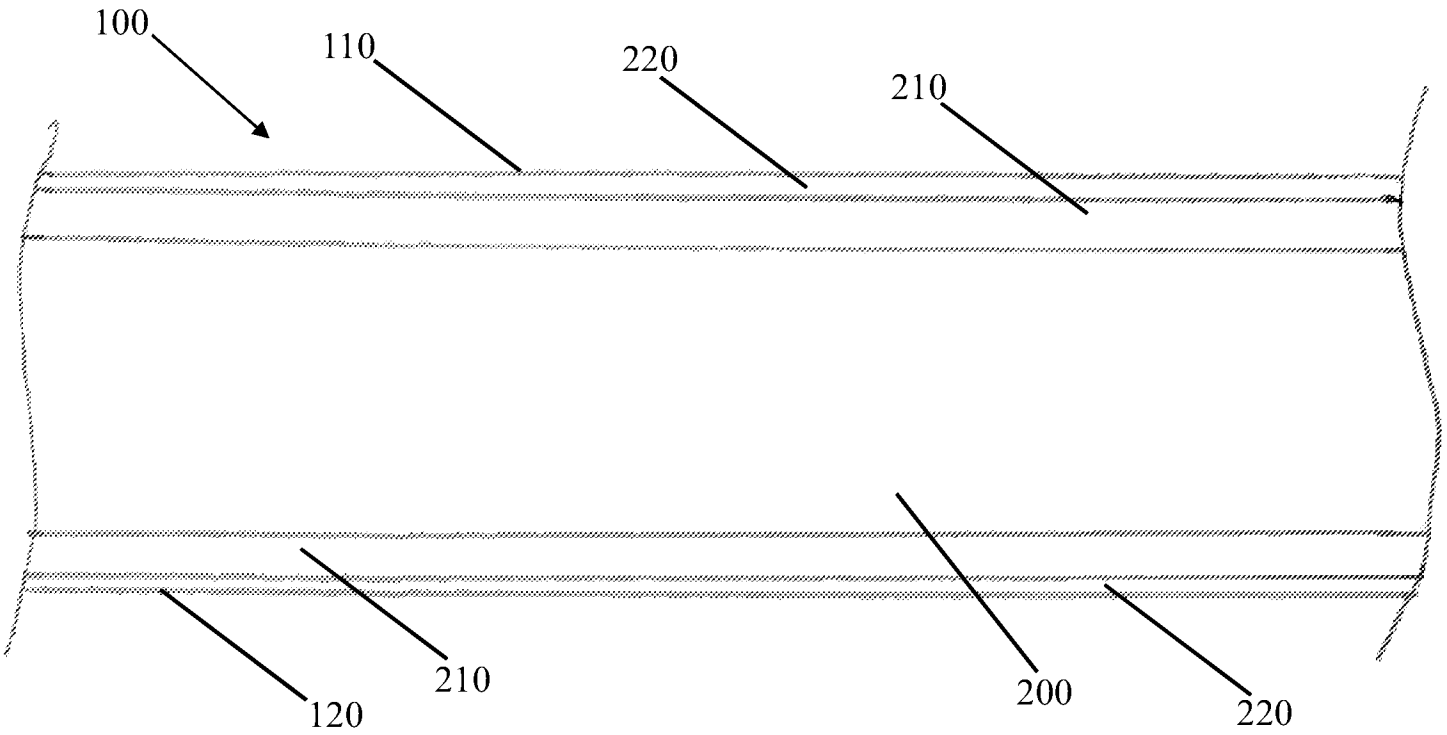
FIG. 3 is a cross-sectional view of a portion of the foundation wall insulation board of FIG. 1.

Referring now to FIG. 3, there is illustrated a cross-section of a non-limiting configuration of the foundation wall insulation board 100. The foundation wall insulation board 100 is illustrated as including three layers, namely a non-woven thermoplastic board layer 200, an outer skin layer 210, and an optional outer coating layer 220. The thickness of the non-woven thermoplastic board layer 200 is generally greater than the thickness of the outer skin layer 210. The thickness of the non-woven thermoplastic board layer 200 is also generally greater than the thickness of the optional outer coating layer 230. The thickness of the non-woven thermoplastic board layer 200 is generally greater than the combined thickness of the outer skin layer 210 and the optional outer coating layer 230. The composition of the non-woven thermoplastic board layer 200 is generally the same as the composition of the outer skin layer 210; however, the density of the outer skin layer 210 is greater than the density of the non-woven thermoplastic board layer 200. The composition of the optional outer coating layer 220 is different from the composition of the non-woven thermoplastic board layer 200 and the composition of the outer skin layer 210.

The non-woven thermoplastic board layer 200 is partially or fully formed of non-woven fibers. The non-woven fibers can be partially or fully formed of polymer fibers. A portion or all of the fibers can optionally be coated with a polymer material that has a different composition from the fiber. The non-woven thermoplastic board layer 200 can optionally include a) shoddy (e.g., shredded fibers that are typically recycled fibers—the shoddy can include woven and/or non-woven fibers), b) one or more stiffener (e.g., resin, woven fabric, etc.), and/or c) one or more fillers (e.g., carbon fibers, boron fibers, glass balls, etc.). In one non-limiting embodiment, the non-woven thermoplastic board layer 200 is partially or fully formed of non-woven polyester fibers wherein a portion or all of the polyester fibers are coated with a polymer having a melting point that is less than the melting point of the polyester fiber. In another non-limiting embodiment, the non-woven thermoplastic board layer 200 is partially formed of non-woven polyester fibers wherein a portion or all of the polyester fibers are coated with a polymer having a melting point that is less than the melting point of the polyester fiber, and wherein the non-woven thermoplastic board layer 200 also includes one or more of shoddy, stiffener and/or filler.

The non-woven thermoplastic board 200 used to partially or fully form the improved foundation wall insulation board 100 can be partially formed by an airlay line process; however; other processes can be used to partially or fully form the non-woven thermoplastic board 200. During the airlay line process, the non-woven fibers and the optional shoddy, stiffener and/or filler are used to form non-woven thermoplastic board 200 having a thickness of 4-8 in. Thereafter, the non-woven thermoplastic board 200 is subjected to one or more heat press processes and/or compression processes to reduce the thickness of the non-woven thermoplastic board 200 by 20-200%. When the non-woven fibers include an outer coating having a melting point that is less than the core fiber, the outer coating can be caused to partially or fully melt during the one or more heat press processes and/or compression processes. Such partial or fully melting of the coating results in the bonding of the partially- or fully-melted coating with surrounding fibers and/or the optional shoddy, stiffener, and/or filler. When the partially- or fully-melted coating cools and resolidifies, the coating facilitates in the bonding together of one or more of the components of the formed non-woven thermoplastic board 200. If the non-woven thermoplastic board 200 includes optional stiffener in the form of a resin or other type of adhesive material, the resin or other type of adhesive material can also facilitate in the bonding together of one or more of the components of the formed non-woven thermoplastic board 200.

During one or more one or more heat press processes and/or compression processes, the outer skin layer 210 is formed on the top and/or bottom surface of the non-woven thermoplastic board 200 to thereby form the improved foundation wall insulation board 100. The improved foundation wall insulation board 100 can then be optionally punched or otherwise cut into blanks of a certain size and shape. Prior to or after the improved foundation wall insulation board 100 is optionally punched or otherwise cut into blanks, the improved foundation wall insulation board 100 can optionally a) be coated on one or more portions of the improved foundation wall insulation board 100 to form an outer coating layer 220, and/or b) have one or more edges chamfered 170.

Figure 5:
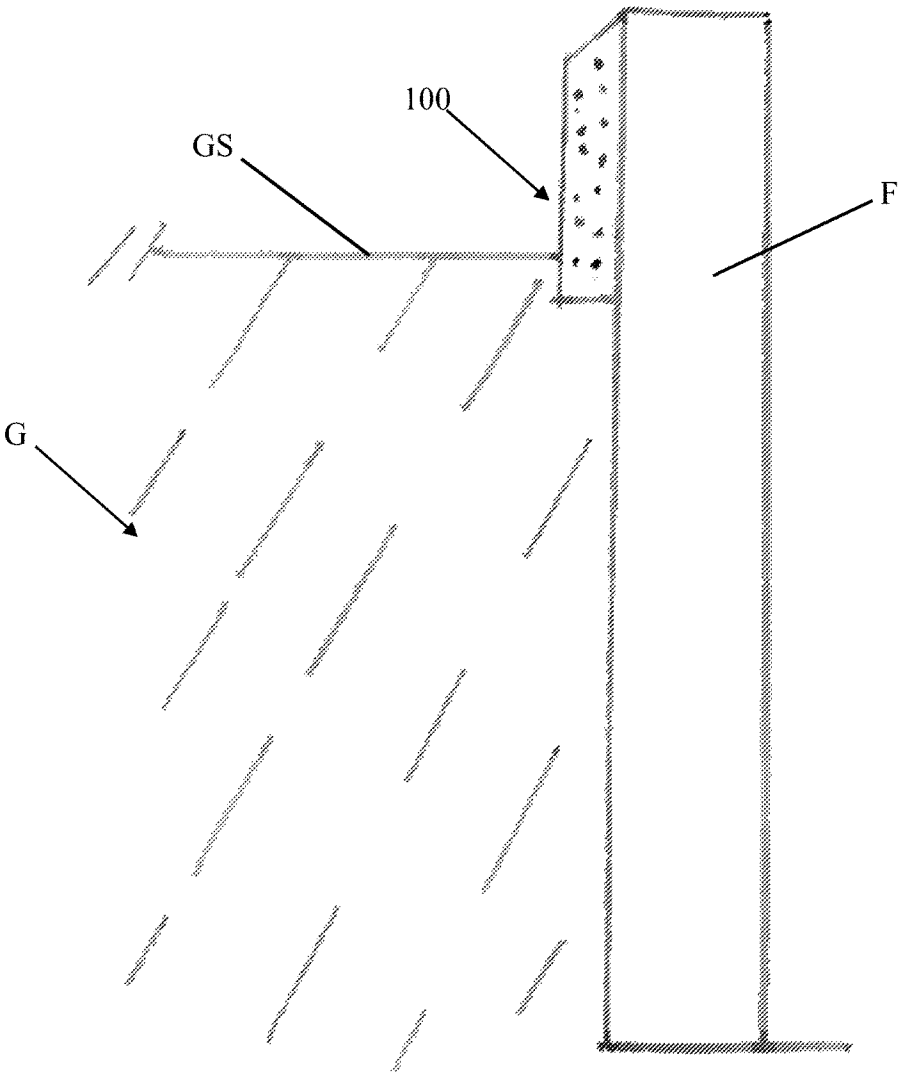
FIG. 5 is a partial side view of a portion of a foundation wall that includes the foundation wall insulation board of FIG. 1 positioned on a portion of the outer surface of the foundation wall.

Referring now to FIG. 5, there is illustrated a non-limiting arrangement for using the improved foundation wall insulation board 100 on an exterior surface of a foundation wall F. As illustrated in FIG. 5, the foundation wall F is partially positioned in the ground G. The improved foundation wall insulation board 100 is illustrated as positioned on the exterior of the foundation wall F such that all or a majority of the improved foundation wall insulation board 100 is located above the ground surface GS. Generally at least 55-100% (and all values and ranges therebetween) of the improved foundation wall insulation board 100 is located above the ground surface GS.

Figure 6:
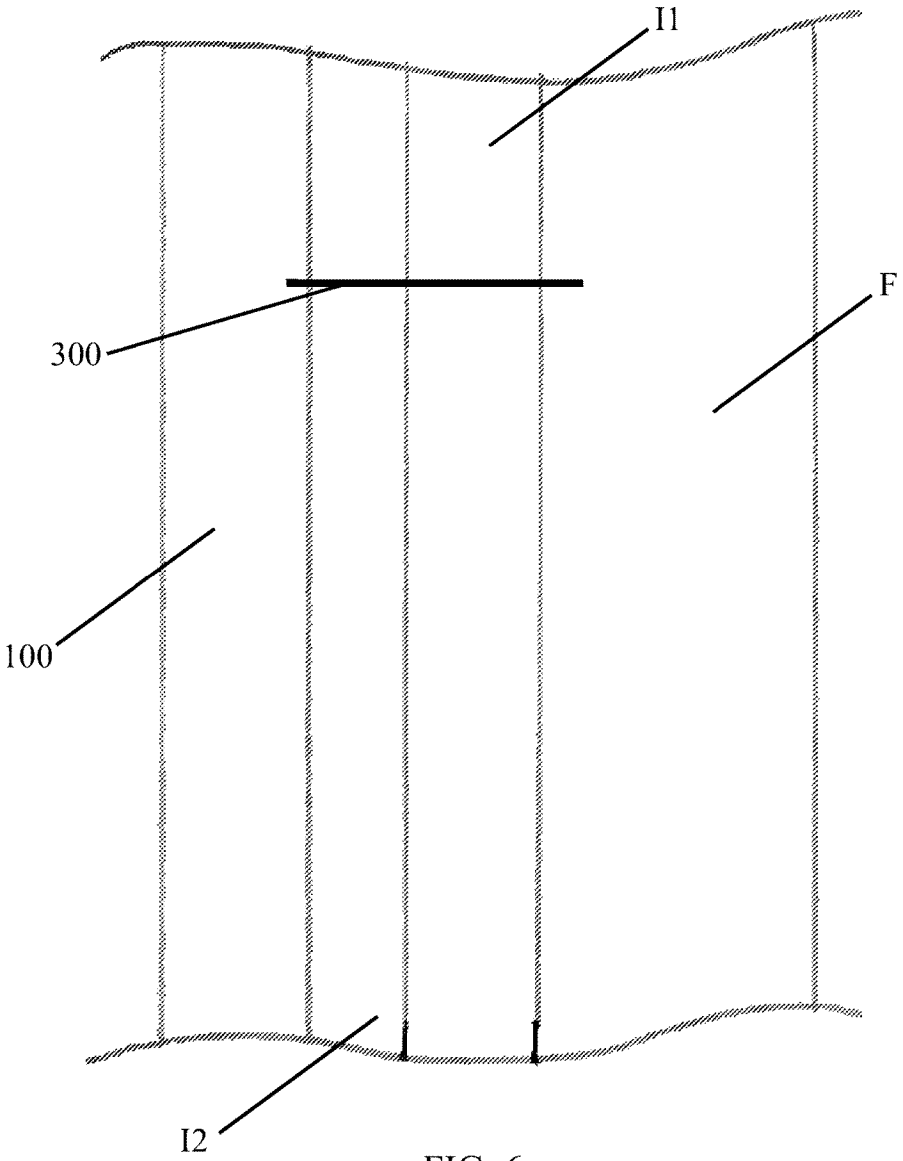
FIG. 6 is an enlarge view of a portion of the foundation wall insulation board of FIG. 1 positioned adjacent to the foundation wall, and wherein one or more optional intermediate layers are positioned between the foundation wall and the foundation wall insulation board.

Referring now to FIG. 6, there is illustrated a non-limiting arrangement for positioning the improved foundation wall insulation board 100 on an exterior surface of a foundation wall F. As illustrated in FIG. 6, one or more intermediate layers I1, I2 can be optionally positioned between the improved foundation wall insulation board 100 on an exterior surface of a foundation wall F. Such one or more intermediate layers I1, I2 can include a waterproof coating, waterproofing membrane, adhesive strips or tape, a sealant coating, an adhesive coating, a UV coating, a drainage board, a dimpled plastic sheet, a panel, drainage pipe, paint, antimicrobial coating, and/or an insulation material. As can be appreciated, the one or more intermediate layers I1, I2 can optionally be used to facilitate in securing the improved foundation wall insulation board 100 in position relative to the foundation wall F.

As also illustrated in FIG. 6, the improved foundation wall insulation board 100 can optionally be at least partially secured to the one or more intermediate layers I1, I2 and/or to the foundation wall F by one or more mechanical connectors 300 (e.g., staple, nail, screw, clip, clamp, rivet, hook, strap, cord, wire, etc.).

The top edge and/or front surface of the improved foundation wall insulation board 100 can optionally include an outer coating layer 220 to inhibit or prevent liquids (e.g., water, paint, etc.) from penetrating into the non-woven thermoplastic board 200 portion of the improved foundation wall insulation board 100.

The improved foundation wall insulation board 100 can extend up to or near the top edge of the foundation wall F; however, this is not required. Although not shown, it will be readily understood by one skilled in the art that one or more other materials can optionally be positioned between the exterior surface of the foundation wall F and the improved foundation wall insulation board 100, namely a) an adhesive layer, b) a waterproofing layer and/or sealant, c) a drainage board, d) insulation, e) waterproofing membrane, f) adhesive strips or tape, g) a UV coating, h) a dimpled plastic sheet, i) a panel, j) drainage pipe, k) paint, and/or l) antimicrobial coating.

To aid the Patent Office and any readers of this application and any resulting patent in interpreting the claims appended hereto, Applicant does not intend any of the appended claims or claim elements to invoke 35 U.S.C. 112(f) unless the words "means for" or "step for" are explicitly used in the particular claim.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween.

What is claimed:

1. A foundation wall insulation board that can be used to provide insulation to an exterior of a foundation wall; said foundation wall insulation board comprises a non-woven board and first and second outer skin layers wherein said first outer skin layer is positioned on top surface of said non-woven board and said second outer skin layer is positioned on a bottom surface of said non-woven board, and wherein said top side of said non-woven board is opposite said bottom side of said non-woven board; said foundation wall insulation board is a rigid, non-rollable board; said foundation wall insulation board is formed of non-woven materials; said non-woven board includes a side edge that extends between said top and bottom sides of said non-woven board; said first outer skin layer is located only on said top surface of said non-woven board; said second outer skin layer is located only on said bottom surface of said non-woven board; said first and second outer skin layers are formed of the same material as said non-woven board; each of said first and second outer skin layers has a density and rigidity that is greater than a density and rigidity of a center or central portion of said non-woven board; each of said first and second outer skin layers has a thickness that is less than a thickness of said non-woven board; said non-woven board is at least partially formed of a plurality of fibers that are not woven together; each of said first and second outer skin layers is formed from an outer portion of said non-woven board that has been subject to compression and heat; each of said first and second outer layers include melted together non-woven material that was caused to be melted when subjected to said compression and heat; said side edge is absent an outer skin that is formed by compressed fibers that include melted together fibers; said foundation wall insulation board has an R-value thermal resistance per inch thickness of at least 1; said plurality of fibers include bi-component fibers; said bi-component fibers include a core fiber and an outer coating; said outer coating on said bi-component fibers has a melting point that is less than a melting point of said core fiber; said core fiber is formed of one or more polymers selected from the group consisting of polyester, polyamide, polyamide nylon fibers, nylon fibers, polyethylene terephthalate (PET), polybutylene terephthalate (PBT), phenol-formaldehyde (PF), polyvinyl chloride, polyolefin, acrylic polyester, polyethylene, urethane, and polyurethane; said outer skin layer at least partially formed of said bi-component fibers being bonded and compressed together using heat and pressure to cause said outer coating to at least partially melt and bond with adjacently positioned bi-component fibers; each of said first and second outer skin layers has a reduced porosity and a reduced rate of water drainage through said first and second outer skin layers as compared to said non-woven board; said foundation wall insulation board is configured to have a vertical liquid drainage; said vertical liquid drainage per inch thickness is less than 125 gallons/hour/lineal-foot/inch at a pressure of 500 pounds per square foot (psf).

2. The foundation wall insulation board as defined in claim 1, wherein said plurality of fibers include polymer fibers.

3. The foundation wall insulation board as defined in claim 1, wherein said polymer fibers include polyester fibers.

4. The foundation wall insulation board as defined in claim 1, wherein said foundation wall insulation board includes shoddy, stiffeners and/or fillers.

5. The foundation wall insulation board as defined in claim 1, wherein said foundation wall insulation board includes one or more supplemental layers that are secured to at least a portion of a top surface of said outer skin layer; said one or more supplemental layers include woven fiber material, plastic sheet, and/or panels.

6. The foundation wall insulation board as defined in claim 1, wherein said foundation wall insulation board includes an outer coating on at least a portion of said foundation wall insulation board; said outer coating includes one or more materials selected from the group consisting of waterproof material, sealant, UV protectant, and antimicrobial coating.

7. The foundation wall insulation board as defined in claim 1, wherein at least a portion of said side edge is chamfered.

8. A method for manufacturing a foundation wall insulation board comprising:

providing a plurality of fibers; said fibers not woven together; said plurality of fibers include bi-component fibers; said bi-component fibers include a core fiber and an outer coating;

said outer coating on said bi-component fibers has a melting point that is less than a metaling point of said core fiber; said core fiber is formed of one or more polymers selected from the group consisting of polyester, polyamide, polyamide nylon fibers, nylon fibers, polyethylene terephthalate (PET), polybutylene terephthalate (PBT), phenol-formaldehyde (PF), polyvinyl chloride, polyolefin, acrylic polyester, polyethylene, urethane and polyurethane;

laying said plurality of fibers so as to form a form of fibers; said form of fibers has an initial thickness; said form of fibers has a top surface and a bottom surface;

compressing said form of fibers to reduce a thickness of said form of fibers from said initial thickness to a compressed thickness to produce a non-woven board and first and second outer skin layers; said compressed thickness of the total thickness of said non-woven board and said first and second outer skin layers is 20-200% less than said initial thickness of said form of fibers;

said first outer skin layer is positioned on top surface of said non-woven board and said second outer skin layer is positioned on a bottom surface of said non-woven board, and wherein said top side of said non-woven board is opposite said bottom side of said non-woven board; said non-woven board includes a side edge that extends between said top and bottom sides of said non-woven board; said first outer skin layer is located only on said top surface of said non-woven board; said second outer skin layer is located only on said bottom surface of said non-woven board; said first and second outer skin layers are formed of the same material as said non-woven board; each of said first and second outer skin layers has a density and rigidity that is greater than a density and rigidity of a center or central portion of said non-woven board; each of said first and second outer skin layers has a thickness that is less than a thickness of said non-woven board; each of said first and second outer skin layers is formed from an outer portion of said non-woven board that has been subject to heat and said step of compressing; each of said first and second outer layers include melted together non-woven material that was caused to be melted when subjected to said heat and said step of compressing; said side edge is absent an outer skin that is formed by compressed fibers that include melted together fibers; said foundation wall insulation board has an R-value thermal resistance per inch thickness of at least 1; said plurality of fibers include bi-component fibers; said bi-component fibers include a core fiber and an outer coating; said outer coating on said bi-component fibers has a melting point that is less than a metaling point of said core fiber; said core fiber is formed of one or more polymers selected from the group consisting of polyester, polyamide, polyamide nylon fibers, nylon fibers, polyethylene terephthalate (PET), polybutylene terephthalate (PBT), phenol-formaldehyde (PF), polyvinyl chloride, polyolefin, acrylic polyester, polyethylene, urethane, and polyurethane; said outer skin layer at least partially formed of said bi-component fibers being bonded and compressed together using heat and pressure to cause said outer coating to at least partially melt and bond with adjacently positioned bi-component fibers; and wherein said foundation wall insulation board has an R-value thermal resistance per inch thickness of at least 1; wherein said foundation wall insulation board is a rigid, non-rollable board; and said wherein foundation wall insulation board is formed of non-woven materials; and wherein each of said first and second outer skin layers has a reduced porosity and a reduced rate of water drainage through said first and second outer skin layers as compared to said non-woven board; said foundation wall insulation board is configured to have a vertical liquid drainage; said vertical liquid drainage per inch thickness is less than 125 gallons/hour/lineal-foot/inch at a pressure of 500 pounds per square foot (psf).

9. The method as defined in claim 8, wherein said plurality of fibers include polymer fibers.

10. The method as defined in claim 8, wherein said step of compressing includes applying heat to said form of fibers.

11. The method as defined in claim 8, wherein said form of fibers includes one or more of shoddy, stiffeners and/or fillers.

12. The method as defined in claim 8, further including the step of applying one or more supplemental layers to at least a portion of a top surface of said outer skin layer; said one or more supplemental layers includes woven fiber material, plastic sheet, and/or panels.

13. The method as defined in claim 8, wherein an outer surface of said foundation wall insulation board includes an outer coating; said outer coating includes one or more materials selected from the group consisting of waterproof material, sealant, UV protectant, and antimicrobial coating.

14. The method as defined in claim 8, further including the step of chamfering at least a portion of a side edge of said foundation wall insulation board.

15. An insulated foundation for a building comprising:

a foundation wall; and a foundation wall insulation board that is positioned adjacent to said foundation wall; said foundation wall insulation board comprises a non-woven board and first and second outer skin layers wherein said first outer skin layer is positioned on top surface of said non-woven board and said second outer skin layer is positioned on a bottom surface of said non-woven board, and wherein said top side of said non-woven board is opposite said bottom side of said non-woven board; said foundation wall insulation board is a rigid, non-rollable board; said foundation wall insulation board is formed of non-woven materials; said non-woven board includes a side edge that extends between said top and bottom sides of said non-woven board; said first outer skin layer is located only on said top surface of said non-woven board; said second outer skin layer is located only on said bottom surface of said non-woven board; said first and second outer skin layers are formed of the same material as said non-woven board; each of said first and second outer skin layers has a density and rigidity that is greater than a density and rigidity of a center or central portion of said non-woven board; each of said first and second outer skin layers has a thickness that is less than a thickness of said non-woven board; said non-woven board is at least partially formed of a plurality of fibers that are not woven together; each of said first and second outer skin layers is formed from an outer portion of said non-woven board that has been subject to compression and heat; each of said first and second outer layers include melted together non-woven material that was caused to be melted when subjected to said compression and heat; said side edge is absent an outer skin that is formed by compressed fibers that include melted together fibers; said foundation wall insulation board has an R-value thermal resistance per inch thickness of at least 1; said plurality of fibers include bi-component fibers; said bi-component fibers include a core fiber and an outer coating; said outer coating on said bi-component fibers has a melting point that is less than a metaling point of said core fiber; said core fiber is formed of one or more polymers selected from the group consisting of polyester, polyamide, polyamide nylon fibers, nylon fibers, polyethylene terephthalate (PET), polybutylene terephthalate (PBT), phenol-formaldehyde (PF), polyvinyl chloride, polyolefin, acrylic polyester, polyethylene, urethane, and polyurethane; said outer skin layer at least partially formed of said bi-component fibers being bonded and compressed together using heat and pressure to cause said outer coating to at least partially melt and bond with adjacently positioned bi-component fibers; each of said first and second outer skin layers has a reduced porosity and a reduced rate of water drainage through said first and second outer skin layers as compared to said non-woven board; said foundation wall insulation board is configured to have a vertical liquid drainage; said vertical liquid drainage per inch thickness is less than 125 gallons/hour/lineal-foot/inch at a pressure of 500 pounds per square foot (psf).

16. The insulated foundation as defined in claim 15, wherein said foundation wall insulation board is located adjacent to an exterior surface of said foundation wall.

17. The insulated foundation as defined in claim 15, wherein said foundation wall insulation board is connected to said foundation wall by a connection arrangement; said connection arrangement includes one or more of adhesive, staple, nail, screw, clip, clamp, rivet, hook, strap, cord, wire, and/or tape.

18. The insulated foundation as defined in claim 15, wherein at least a portion of said foundation wall insulation board is located above a ground surface.

19. The insulated foundation as defined in claim 15, wherein one or more intermediate layers are positioned between said foundation wall and said foundation wall insulation board; said one or more intermediate layers includes a waterproof coating, waterproofing membrane, adhesive strips or tape, a sealant coating, an adhesive coating, a UV coating, a drainage board, a dimpled plastic sheet, a panel, drainage pipe, paint, antimicrobial coating, and/or an insulation material.

20. A method for forming an insulated foundation comprising:

providing a foundation wall;

providing a foundation wall insulation board; said foundation wall insulation board comprises a non-woven board and first and second outer skin layers wherein said first outer skin layer is positioned on top surface of said non-woven board and said second outer skin layer is positioned on a bottom surface of said non-woven board, and wherein said top side of said non-woven board is opposite said bottom side of said non-woven board; said foundation wall insulation board is a rigid, non-rollable board; said foundation wall insulation board is formed of non-woven materials; said non-woven board includes a side edge that extends between said top and bottom sides of said non-woven board; said first outer skin layer is located only on said top surface of said non-woven board; said second outer skin layer is located only on said bottom surface of said non-woven board; said first and second outer skin layers are formed of the same material as said non-woven board; each of said first and second outer skin layers has a density and rigidity that is greater than a density and rigidity of a center or central portion of said non-woven board; each of said first and second outer skin layers has a thickness that is less than a thickness of said non-woven board; said non-woven board is at least partially formed of a plurality of fibers that are not woven together; each of said first and second outer skin layers is formed from an outer portion of said non-woven board that has been subject to compression and heat; each of said first and second outer layers include melted together non-woven material that was caused to be melted when subjected to said compression and heat; said side edge is absent an outer skin that is formed by compressed fibers that include melted together fibers; said foundation wall insulation board has an R-value thermal resistance per inch thickness of at least 1; said plurality of fibers include bi-component fibers; said bi-component fibers include a core fiber and an outer coating; said outer coating on said bi-component fibers has a melting point that is less than a metaling point of said core fiber; said core fiber is formed of one or more polymers selected from the group consisting of polyester, polyamide, polyamide nylon fibers, nylon fibers, polyethylene terephthalate (PET), polybutylene terephthalate (PBT), phenol-formaldehyde (PF), polyvinyl chloride, polyolefin, acrylic polyester, polyethylene, urethane, and polyurethane; said outer skin layer at least partially formed of said bi-component fibers being bonded and compressed together using heat and pressure to cause said outer coating to at least partially melt and bond with adjacently positioned bi-component fibers; each of said first and second outer skin layers has a reduced porosity and a reduced rate of water drainage through said first and second outer skin layers as compared to said non-woven board; said foundation wall insulation board is configured to have a vertical liquid drainage; said vertical liquid drainage per inch thickness is less than 125 gallons/hour/lineal-foot/inch at a pressure of 500 pounds per square foot (psf); and positioning said foundation wall insulation board adjacent to said foundation wall.

* * * * *